US010697695B1

(12) United States Patent
Bradley

(10) Patent No.: US 10,697,695 B1
(45) Date of Patent: Jun. 30, 2020

(54) REFRIGERATOR STORAGE SYSTEM

(71) Applicant: Danby Products Limited, Guelph (CA)

(72) Inventor: Oliver Bradley, Guelph (CA)

(73) Assignee: Danby Products Limited, Guelph (CA)

( * ) Notice: Subject to any disclaimer, the term of this patent is extended or adjusted under 35 U.S.C. 154(b) by 0 days.

(21) Appl. No.: 16/273,332

(22) Filed: Feb. 12, 2019

Related U.S. Application Data

(60) Provisional application No. 62/635,863, filed on Feb. 27, 2018.

(51) Int. Cl.
*F25D 23/04* (2006.01)
*F25D 25/02* (2006.01)
*F25D 23/02* (2006.01)

(52) U.S. Cl.
CPC ..... *F25D 23/04* (2013.01); *F25D 25/024* (2013.01); *F25D 25/027* (2013.01); *F25D 23/028* (2013.01)

(58) Field of Classification Search
CPC ..... F25D 23/04; F25D 23/028; F25D 25/024; F25D 25/027
USPC ..... 312/405.1
See application file for complete search history.

(56) References Cited

U.S. PATENT DOCUMENTS 2,576,691 A * 11/1951 Money ..... F25D 23/04 312/405.1
4,186,978 A * 2/1980 Thomson ..... F25D 23/04 211/80
5,513,910 A * 5/1996 Ellingwood ..... A47B 96/16 211/106
5,567,029 A * 10/1996 Haenisch ..... F25D 23/04 211/100
6,905,183 B2 * 6/2005 Leimkuehler ..... F25D 23/04 312/405.1
6,908,163 B1 * 6/2005 Hebeler ..... F25D 23/04 312/321.5
7,472,974 B2 * 1/2009 Czach ..... F25D 23/04 312/321.5
7,552,983 B2 * 6/2009 Shin ..... F25D 23/04 312/321.5
8,336,976 B2 * 12/2012 Lee ..... F25D 23/04 312/405.1
8,746,818 B2 * 6/2014 Meese ..... F25D 23/04 211/153
8,864,252 B1 * 10/2014 Rodriguez Cobas ... F25D 23/04 312/321.5
9,671,154 B1 * 6/2017 Shrader ..... F25D 23/04
(Continued)

*Primary Examiner* — Daniel J Troy
*Assistant Examiner* — Timothy M Ayres
(74) *Attorney, Agent, or Firm* — Ralph E. Jocke; Colin P. Cochran; Walker & Jocke

(57) ABSTRACT

A refrigerator (10) provides configurable storage in an interior area of a refrigerator door (16). Door shelves (32, 34) are releasably attachable to inside faces (20) of the door in a first configuration in which the door shelves hold items in a substantially vertical orientation, and in a second configuration in which the door shelves hold items in a tilted orientation. Foldout door shelves (64, 66) are rotatably positioned in operatively supported connection with the inside faces of the door. Each of the foldout door shelves is selectively movable between a retracted position in which the shelf is positioned adjacent to a vertically extending inside face of the door, and extended positioned in which an item supporting surface (68, 70) of the respective shelf extends outward to hold items in a tilted orientation.

28 Claims, 11 Drawing Sheets

(56) References Cited

U.S. PATENT DOCUMENTS

| | | | | |
|---|---|---|---|---|
| 2004/0012314 | A1* | 1/2004 | Hay | A47B 46/005<br>312/405.1 |
| 2015/0176887 | A1* | 6/2015 | Castro Solis | F25D 25/025<br>312/405.1 |

* cited by examiner

REFRIGERATOR STORAGE SYSTEM

TECHNICAL FIELD

Exemplary embodiments relate to refrigerators used in household and commercial environments. Exemplary embodiments further relate to an expandable storage arrangement within an interior area of a refrigerator that is configurable to store additional items such as beverage containing cans, when desired by the user.

BACKGROUND

Refrigerators are used in household and commercial environments to maintain items cold and/or frozen until they are ready to be consumed. The storage space that is available within an interior area of a refrigerator is limited. Sometimes users like to chill items such as beverages within the interior area of the refrigerator. However the limited space within the refrigerator does not allow all the beverage containing cans or other containers to be placed therein.

Storage arrangements within the interior area of refrigerators may benefit from improvements.

SUMMARY

Exemplary embodiments relate to a refrigerator with an interior area in which items to be chilled are stored. An exemplary refrigerator includes configurable storage for containers, such as beverage containing cans, in the door of the refrigerator Exemplary arrangements include door shelves which are mountable in releasable fixed connection with at least one inside face of the door in a configuration in which each door shelf has a shelf front wall that extends substantially vertically and a shelf bottom wall that extends substantially horizontally. Each door shelf is selectively changeable to be in attached connection with at least one inside face of the door in an alternative configuration in which the front wall extends outward at an acute angle and the bottom wall extends outward at an obtuse angle relative to the inside face of the door. In this configuration each door shelf is configured to hold containers such as beverage containing cans in a tilted orientation.

In exemplary embodiments foldout door shelves are movably mounted in connection with at least one inside face of the refrigerator door. Each of the foldout door shelves is movable from a retracted foldout door shelf position in which the shelf extends substantially vertically and is in abutting relation with an inside face of the door. Each foldout door shelf is movable to an alternative position in which the shelf extends outwardly from the inside face of the door and has an item support surface that extends at an acute angle substantially similar to that of the front wall of a door shelf when the door shelf is in the alternative configuration.

In the exemplary embodiments each door shelf when positioned in the initial configuration, is operative to engage and hold a foldout door shelf in the retracted position where the foldout door shelf extends substantially parallel to the vertically extending inside face of the door. Removing the door shelf from attached connection with the door enables moving the foldout door shelf to the alternative position so that the shelf item support surface thereof extends at an acute angle. The door shelf may then be reattached to the door in the alternative configuration in which the door shelf front surface also extends at substantially the same acute angle.

In the exemplary embodiment, changing the configuration and position of the door shelves and the foldout door shelves can effectively double the available storage space for containers such as beverage holding cans. Numerous other useful features are also provided by the exemplary embodiments described herein.

DETAILED DESCRIPTION

Figure 1:
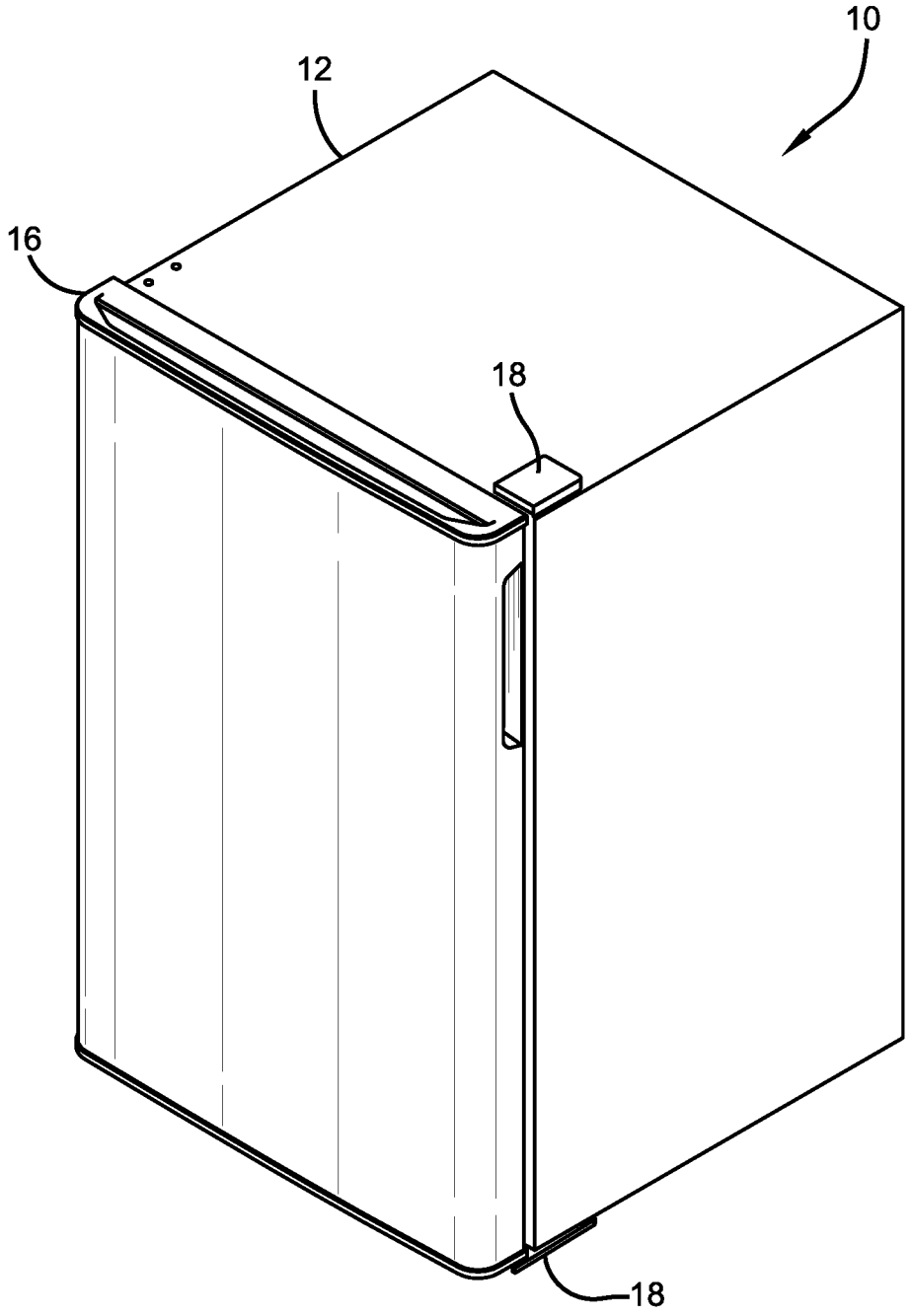
FIG. 1 is a front right perspective view of a refrigerator that incorporates the storage arrangement of an exemplary embodiment, with the refrigerator door shown in a closed position.
Figure 2:
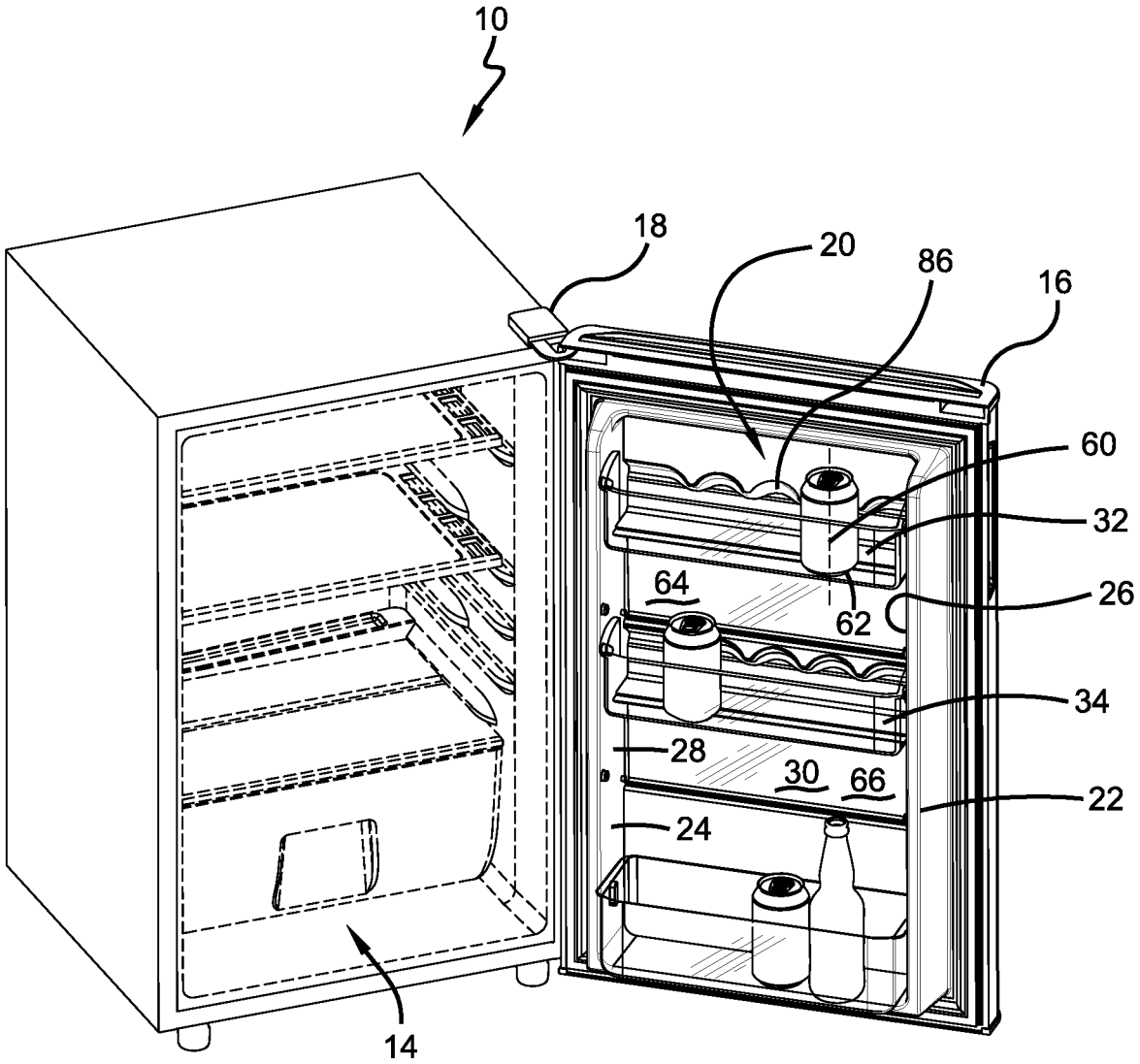
FIG. 2 is a front left perspective view of the refrigerator, with the refrigerator door shown in an open position.

Referring now to the drawings and particularly to FIG. 1, there is shown therein an exemplary refrigerator generally indicated 10. The refrigerator 10 includes a housing 12. The housing 12 bounds an interior area 14 as shown in FIG. 2. The refrigerator 10 further includes a door 16. The door 16 is movably mounted in operatively supported connection with the housing 12 through hinges 18. The door 16 is movable between a closed position shown in FIG. 1 in which the interior area is not accessible from outside the housing, and an open position shown in FIG. 2 in which the interior area is accessible from outside the housing. The interior area 14 may include numerous shelves and compartments such as those shown in phantom.

The exemplary refrigerator 10 further includes structures and devices that operate to keep the interior area 14 cooler than ambient temperature. This may be done using features like those described in U.S. patent application Ser. No.

15/239,378 filed Aug. 17, 2016 the disclosure of which is incorporated herein by reference in its entirety.

The refrigerator door 16 includes at least one vertically extending inside face generally indicated 20. In the exemplary arrangement the at least one inside face has a configuration that enables storing items within one or more storage areas provided by shelves on the interior area side of the door. In the exemplary arrangement the at least one inside face of the refrigerator door includes a pair of horizontally disposed inward extending door projections 22, 24. Each door projection is configured to extend inwardly from the door toward the interior area 14 when the door is in the closed position. Door projection 22 includes a side face 26. Door projection 24 includes a side face 28. In the exemplary arrangement side faces 26 and 28 are in substantially facing relation and extend substantially parallel to one another and bound a door recess generally indicated 30 that extends between the side faces. For purposes hereof substantially facing relation and substantially parallel with regard to the side faces means that each of the side faces extend inward from the inside face and at an angle of 90°±20° relative to a vertically extending plane.

In the exemplary arrangement a pair of door shelves 32, 34 are positioned in releasably operatively attached connection with the at least one inside face of the door. It should be understood that the use of two vertically spaced door shelves is exemplary, and in other embodiments other numbers of door shelves may be used. In the exemplary arrangement the door shelves are identical and so only door shelf 32 will be described in detail.

Figure 3:
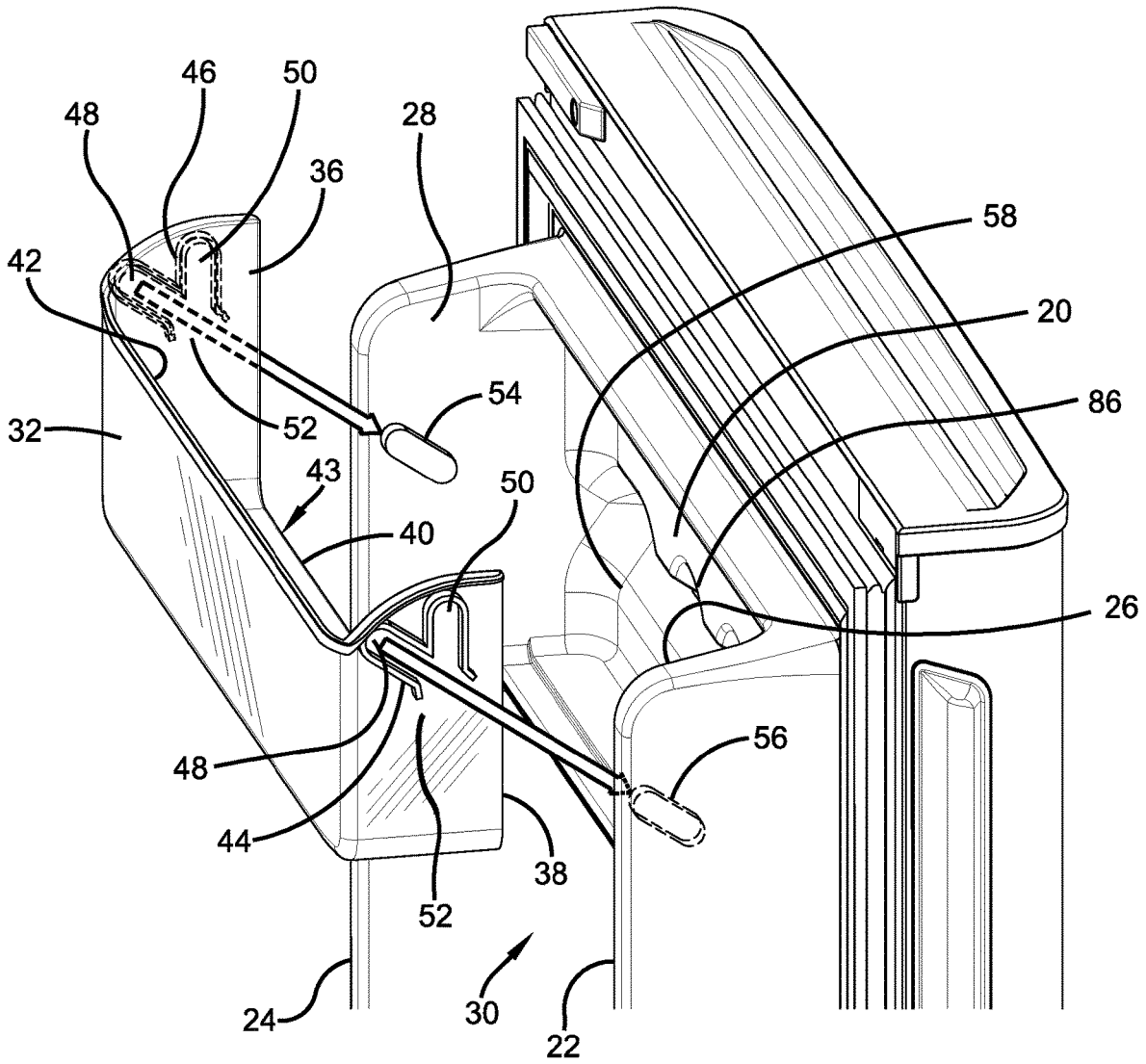
FIG. 3 is a perspective view showing a direction of movement for a door shelf to be in attached connection with the door in a first door shelf configuration.

As shown in FIG. 3 door shelf 32 includes a pair of horizontally disposed shelf side walls 36, 38. The exemplary door shelf further includes a shelf bottom wall 40. Shelf bottom wall 40 extends substantially perpendicular to and horizontally between the shelf side walls 36 and 38. The exemplary door shelf 32 further includes a shelf front wall 42. Shelf front wall 42 extends between and substantially perpendicular to each of the side walls 36 and 38, as well as substantially perpendicular to the shelf bottom wall 40. The shelf side walls, shelf bottom wall and shelf front wall bound a shelf storage recess 43. For purposes of the relationships described in this paragraph substantially perpendicular means 90°±20°.

The exemplary embodiment of door shelf 32 includes shelf wall projections 44, 46. Shelf wall projection 44 comprises a continuous border wall that extends outward on the outside surface of side wall 38. Shelf wall projection 46 comprises a similar projection bounded by a continuous border wall that extends in an outward direction on the outside surface of shelf side wall 36. The border wall of each respective shelf wall projection is operative to define a first recess 48 and a second recess 50. Each of recesses 48 and 50 are accessible through respective common openings 52.

In an exemplary arrangement a shelf projection 54 is in fixed operatively attached connection with side face 28 of door projection 24. A similar shelf projection 56 is in fixed operatively attached connection with side face 26 of door projection 22. In the exemplary arrangement projections 54, 56 extend inwardly in facing relation in the door recess 30 between the door projections 22, 24. In the exemplary arrangement the first and second recesses 48 and 50 of shelf wall projections 44 and 46, are each configured to accept projections 54 and 56 therein in interengaging relation. The respective shelf side walls 36 and 38 upon which the shelf wall projections extend are configured to be in generally close-fitting relation with the adjacent side faces 28 and 26 when the shelf projections are engaged with the shelf wall recesses.

As represented in FIG. 3, door shelf 32 is attachable to the door in a first configuration through engagement of shelf projections 54, 56 in first recesses 48. The engagement of the projections and recesses is operative to hold the door shelf in fixed immovable attached connection with the inside faces of the door except for movement linearly straight along the direction of the arrow, upward and away from the door as shown. In the first configuration, the shelf front wall 42 extends substantially vertically, which for purposes of the shelf front wall herein means vertically with no more than a ±20° variation from vertical. In this configuration the shelf bottom wall 40 extends substantially horizontally, which for purposes of the shelf bottom wall herein means horizontally with no more than ±20° variation from horizontal. As can be appreciated, with the door shelf in attached connection with the shelf projections, the shelf storage recess 43 and a substantially vertically extending inside face 58 of the door, provide a storage area into which items can be inserted and removed from the opening at the top of the storage area. For purposes of the door inside face, substantially vertically means vertically with no more than ±20° variation from vertical. Items placed into the shelf storage recess 43 when the door shelf 32 is in attached connection with the door are securely held therein and prevented from being dislodged therefrom as a result of movement of the door or other actions, other than the deliberate manual removal of the item from engagement with the door shelf. FIG. 2 shows door shelves 32 and 34 in the first configuration each holding an exemplary item in the form of a standard beverage containing can therein.

Figure 4:
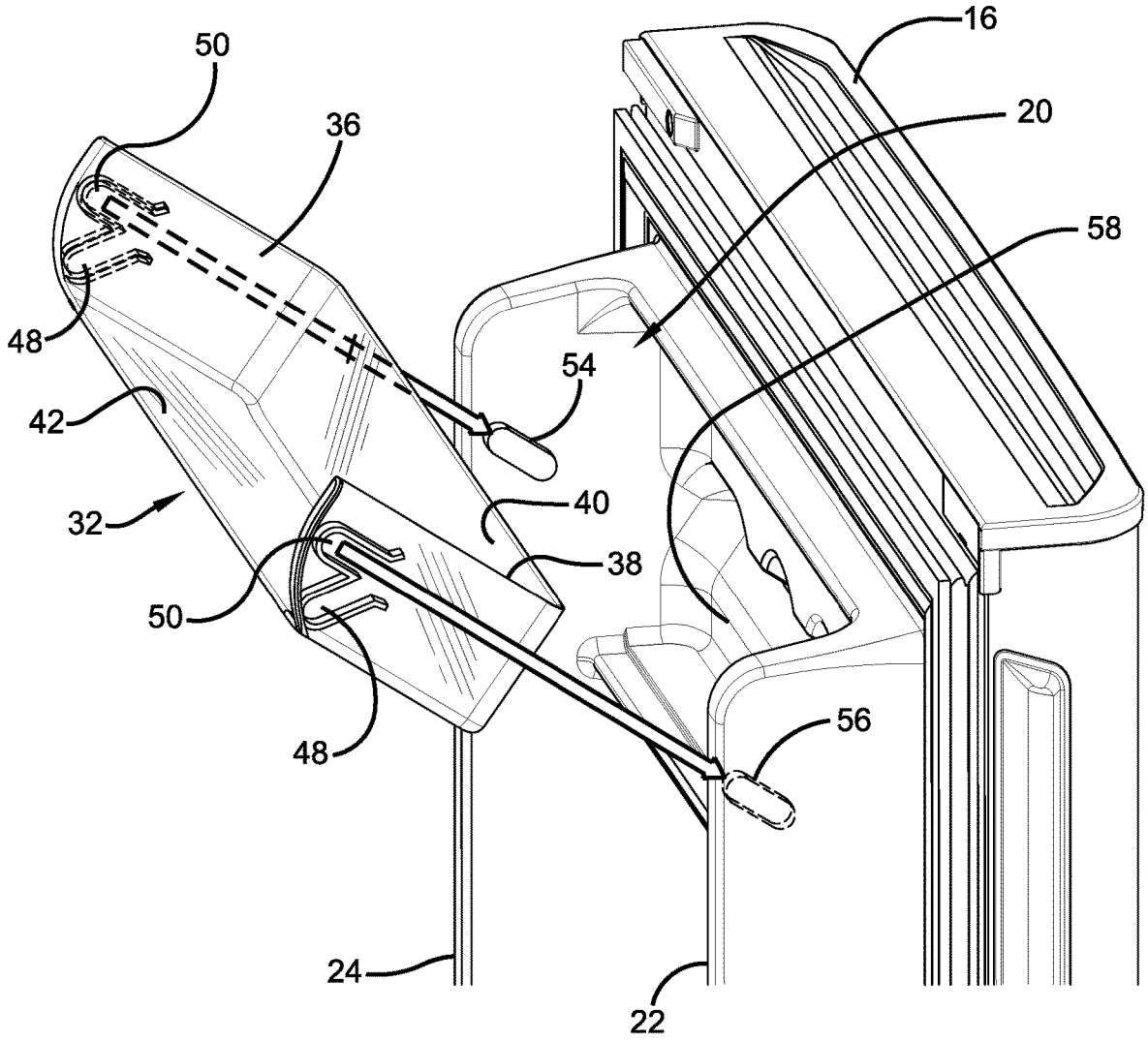
FIG. 4 is a perspective view showing a direction of movement of a door shelf to be in attached connection with the door in a second door shelf configuration.

FIG. 4 shows the attachment of door shelf 32 in a second configuration in which the shelf is specifically configured for holding containers, such as beverage containing cans or other holding containers. To place the door shelf in this configuration, shelf 32 is detached from the inside surfaces of the door by moving the shelf linearly straight and upwardly along the direction of the arrow shown in FIG. 3, so that shelf projections 54 and 56 are disengaged from recesses 48. The shelf is then reattached with the shelf projections 54 and 56 engaged in recesses 50 by moving downwardly along the direction of the arrow in FIG. 4. In this second configuration of the door shelf 32, the shelf is immovable relative to the door other than in the disengagement direction upwardly along the direction of the arrow. Further in this second configuration of the door shelf the shelf front wall 42 extends at an acute angle relative to the vertical direction and the substantially vertically extending inside face 58 of the refrigerator door. In exemplary arrangements in the second door shelf configuration, the shelf front wall 42 extends at an acute angle of about 60° outward relative to substantially vertically extending face 58. For purposes herein an acute angle of the shelf front wall will be considered to be from 30° to 80° relative to the vertical direction. This arrangement provides for substantially cylindrical beverage containing cans that may be positioned in connection with the door shelf to be tilted outwardly such that a central axis 60 of an exemplary beverage containing can 62 (see FIG. 2) will extend at a similar angle to that of the shelf front wall.

In the second configuration of the door shelf shown in FIG. 4, the shelf bottom wall 40 extends at an obtuse angle outward relative to the substantially vertically extending inside face 58 of the door and with regard to the vertical direction. The shelf bottom wall serves to engage the bottoms of the containers and hold them in the tilted out position.

Figure 7:
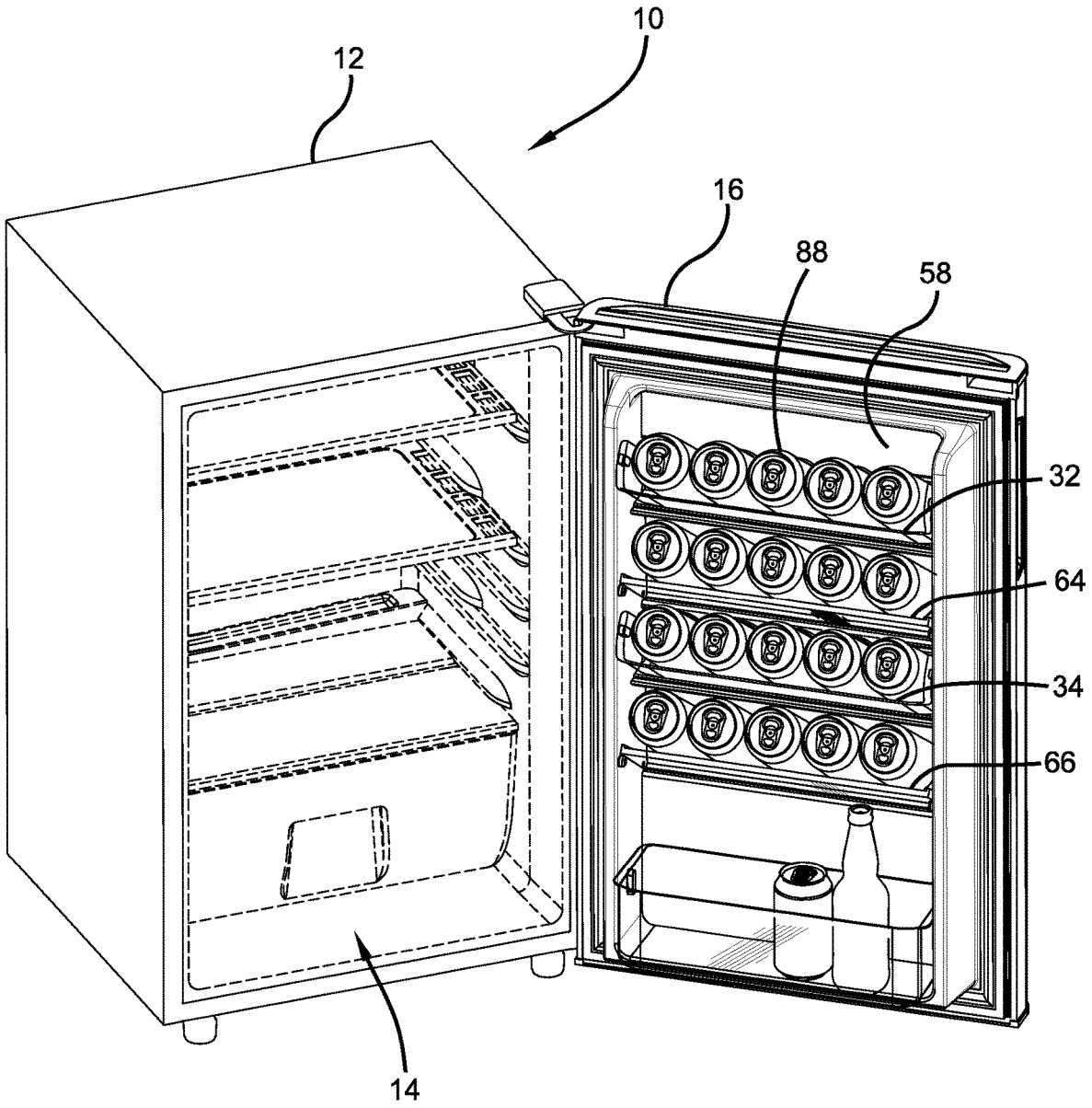
FIG. 7 is a view of the refrigerator similar to FIG. 6 but with the door shelves and foldout door shelves filled with beverage holding containers.

In exemplary embodiments the door shelves 32, 34 are configured to accommodate a plurality of beverage containing cans, such as cans which generally have approximately a 2½ inch diameter and 5 inch height. However for purposes hereof the term "cans" shall be deemed to include bottles or other containers which may have a diameter in a range under about 3 inches and a height that may vary and be more or less than 5 inches. As can be understood, the dimensions of the particular containers to be held by the door shelves will depend on the particular door shelf dimensions and the available space which may limit the extent to which containers may extend into the interior area of the refrigerator. FIG. 7 shows a plurality of cans of the standard dimensions in operatively supported connection with door shelves 32 and 34.

Figure 10:
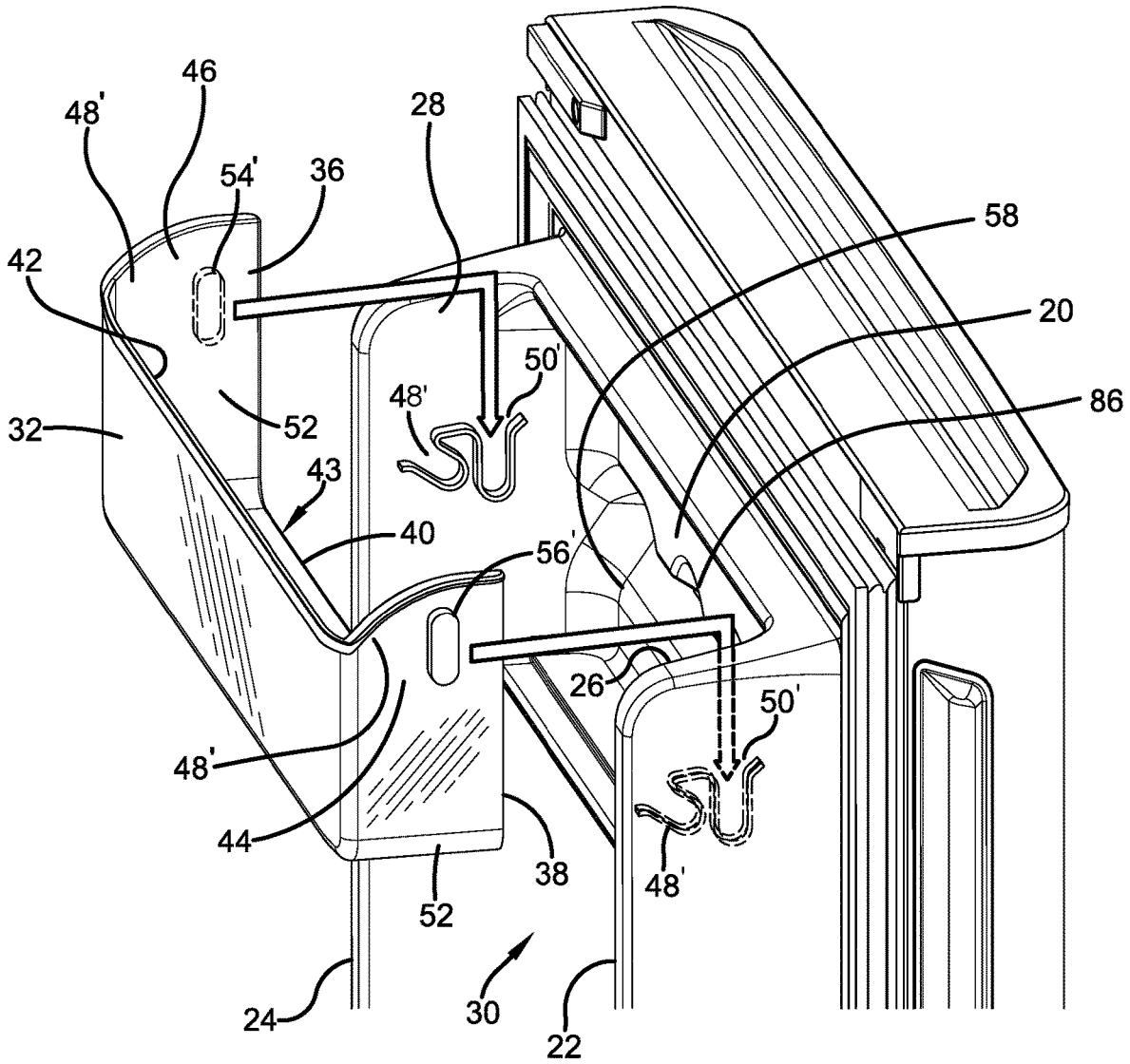
FIG. 10 is a perspective view showing a direction of movement of a door shelf to be in attached connection with the door in a first door shelf configuration and with the side faces of the refrigerator door projections having recesses and the side walls of the door shelf having projections.
Figure 11:
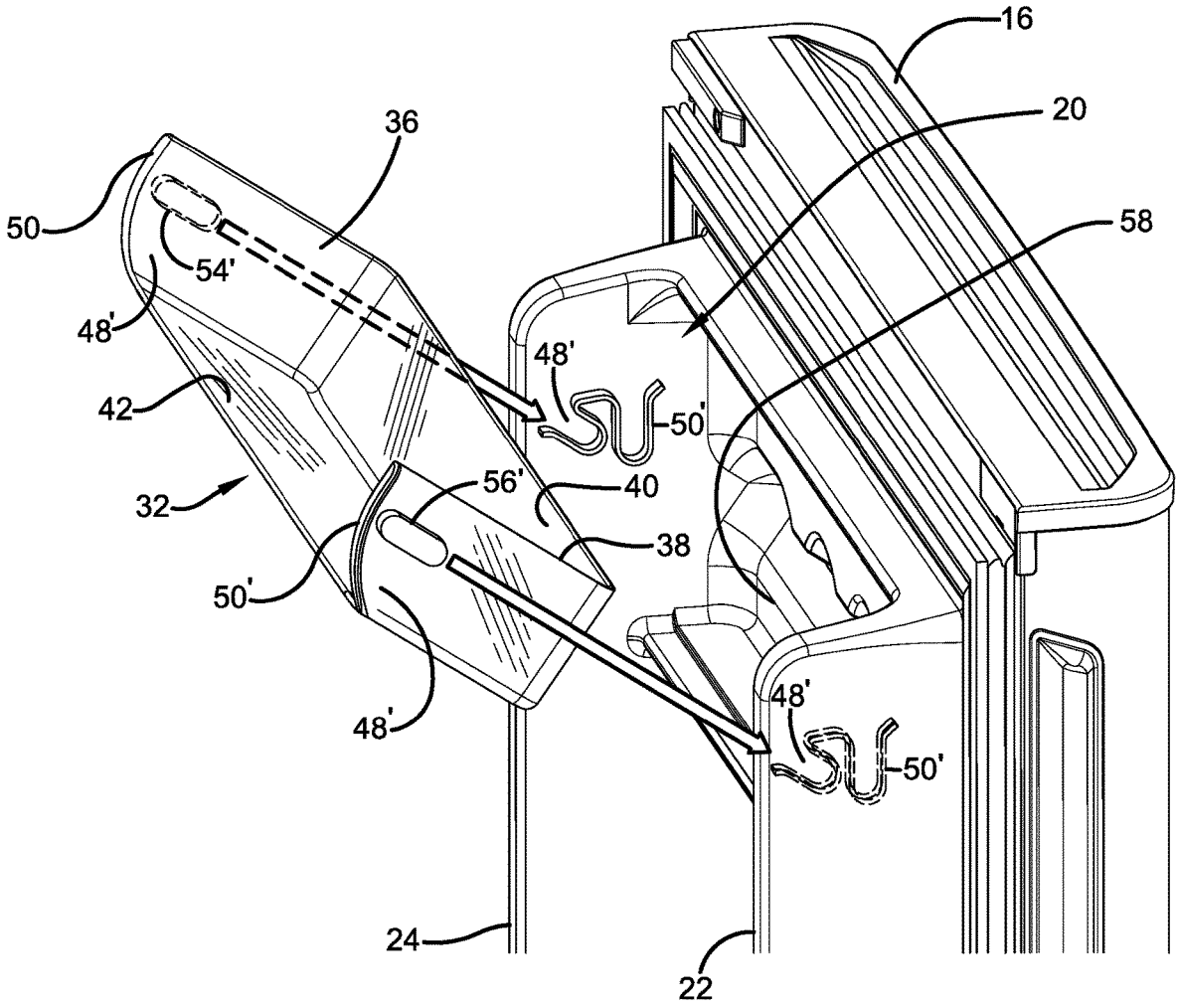
FIG. 11 is a perspective view showing a direction of movement of a door shelf to be in attached connection with the door in a second shelf configuration and with the side faces of the refrigerator door projections having recesses and the side walls of the door shelf having projections.

While in the exemplary embodiment the door shelves 32, 34 are supported by an arrangement of interengaging projections and recesses in which the projections are in fixed operatively attached connection with the inside faces of the door and the recesses are in fixed operatively attached connection with the side walls of the shelf, it should be understood that this arrangement is exemplary. The arrangement may be reversed in other embodiments so that the projections 54', 56' are in fixed operatively attached connection with the shelves and the recesses 48', 50' are in fixed operatively attached connection with the side faces of the door projections, as shown in FIGS. 10 and 11. Alternatively other arrangements may have each of the shelf and the door including or in fixed operatively attached connection with both projections and recesses. In addition, other embodiments may use other types of attachment methods and arrangements for connecting the positionable shelves in attached connection with the door to achieve the benefits of the exemplary embodiments described herein.

Figure 8:
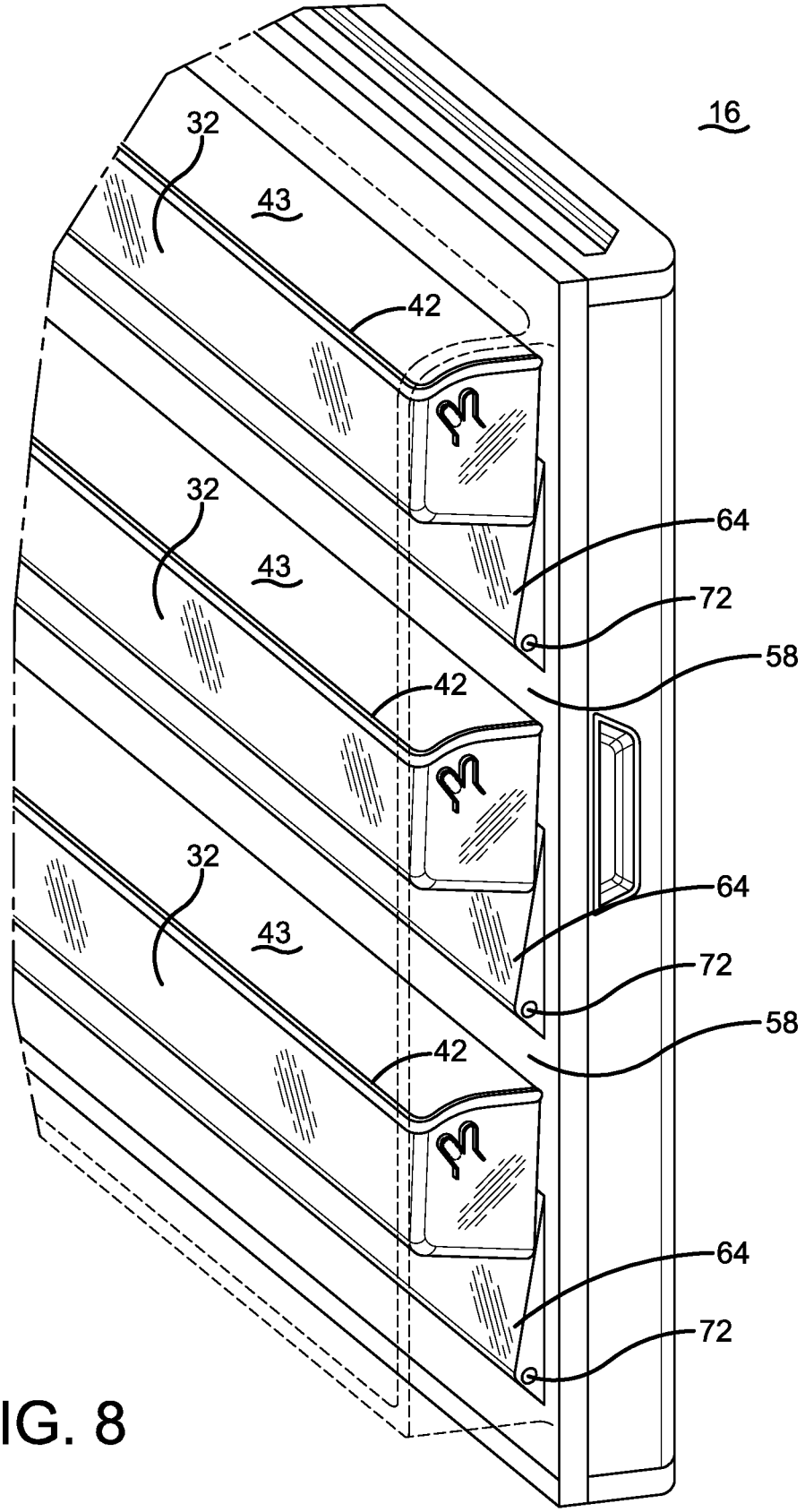
FIG. 8 is a partial top right perspective view showing door shelves in a first door shelf configuration and foldout door shelves in the first foldout door shelf position.

The exemplary refrigerator 10 further includes a plurality of foldout door shelves 64, 66 in attached connection with the inside faces of the refrigerator door. In exemplary arrangement each of the foldout door shelves is in movable rotatable supported connection with the door projections 22 and 24. The exemplary foldout door shelves, as shown in FIG. 8, are configured to be positioned in a first position when not in use such that the foldout door shelf is in a retracted position and extends substantially vertically adjacent to the substantially vertically extending inside face 58 of the door. For purposes of the inside door shelves, substantially vertically means vertically with no more than ±20° variation from vertical. In the retracted position, as shown in FIG. 8, each foldout door shelf can be held in the retracted position by engagement with one of the door shelves 32, 34. When the respective door shelf that holds the foldout door shelf in the retracted position is removed from attached engagement with the door, the respective previously engaged foldout door shelf can be rotatably moved and extended to a second position in which an item support surface of the foldout door shelf extends at an angle that is substantially the same as and in substantially parallel relation with the shelf front walls 42 of the door shelves in the second shelf configuration. For purposes herein an acute angle of the item support surface of a foldout shelf shall be deemed to be from 30° to 80° relative to the vertical direction and an item support surface in this angular range shall be considered to be in substantially parallel relation with the shelf front walls of the door shelves in the second shelf configuration.

Figure 6:
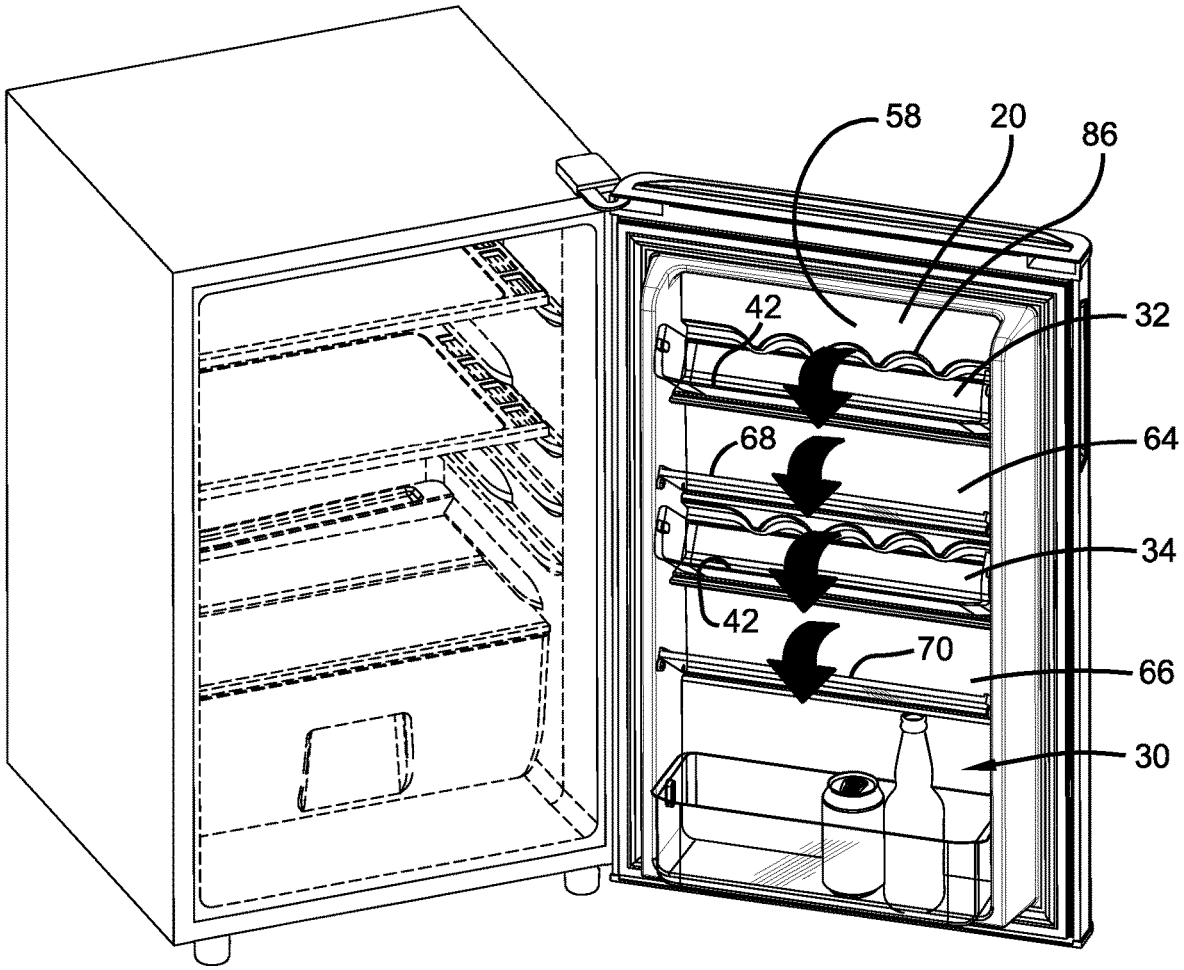
FIG. 6 shows the refrigerator door of FIG. 2 with the door shelves positioned in the alternative configuration and the foldout shelves positioned in the extended position.

FIG. 6 shows door shelves 32 and 34 in attached connection with the refrigerator door and positioned in the second configuration. Foldout door shelves 64 and 66 are shown in a second foldout door shelf position. Foldout door shelves 64, 66 each include item support surfaces 68 and 70 respectively. In the second position of the foldout shelves 64, 66 shown in FIG. 6, the foldout shelf item support surfaces extend outward relative to the substantially vertically extending door inside face 58 at an acute angle. This acute angle corresponds in the exemplary arrangement substantially to the acute angle of the shelf front walls 42 of the door shelves. This enables the item supporting surfaces of the foldout shelves to support containers such as beverage containing cans thereon in generally the same tilted orientation in which such cans are held by the door shelves. This is shown for example in FIG. 7.

Figure 9:
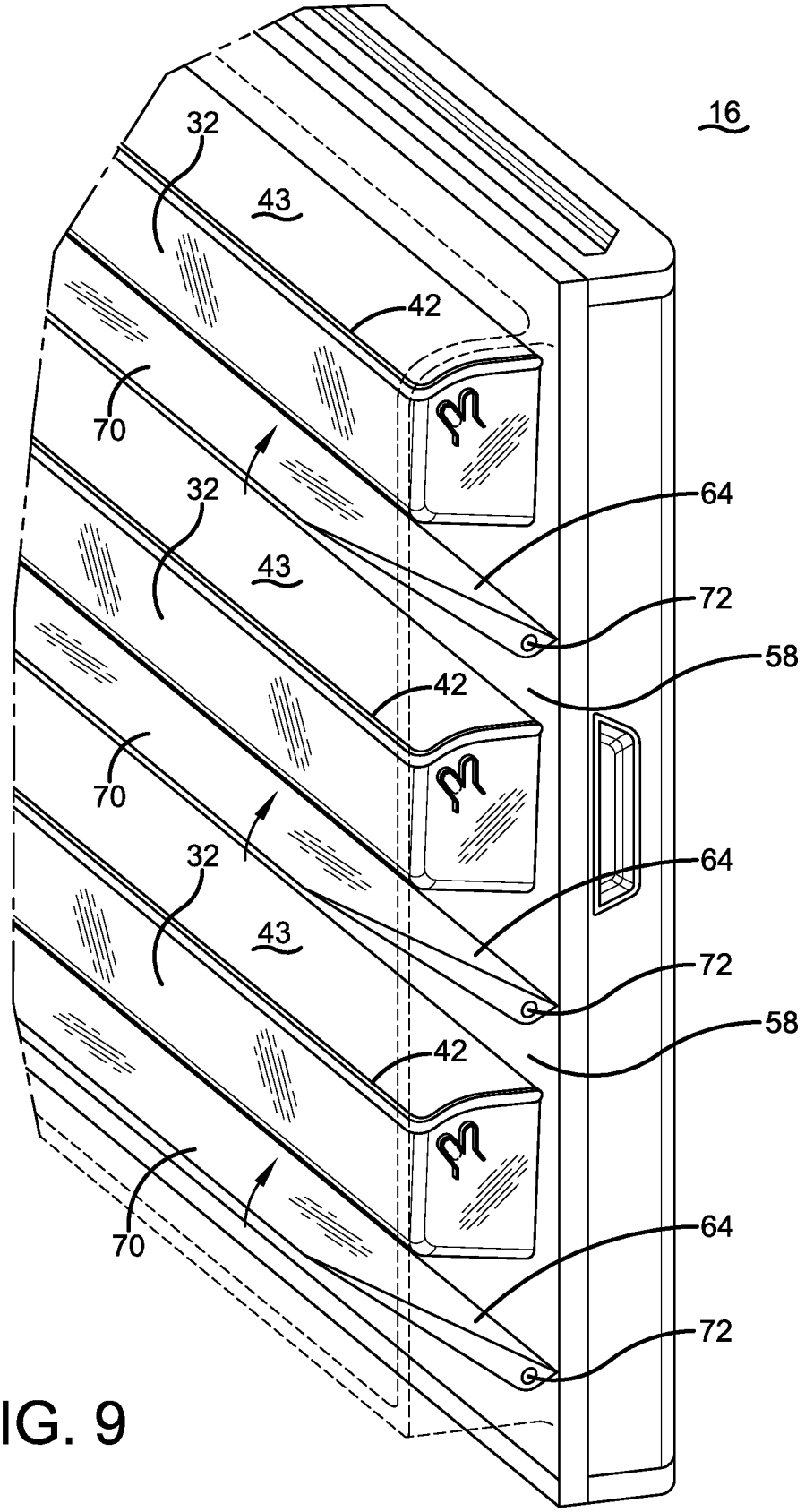
FIG. 9 is a partial top right perspective view showing the door shelves in a first door shelf configuration and foldout door shelves in the second foldout door shelf position.

In the exemplary arrangement, as shown in FIG. 9, when a door shelf is in attached connection with the door, the door shelf prevents the foldout door shelf adjacent thereto from being moved from the extended second position to the retracted first position. However, in other embodiments the foldout shelves may be movable between the extended and retracted positions with the adjacent door shelves in attached connection with the door.

Figure 5:
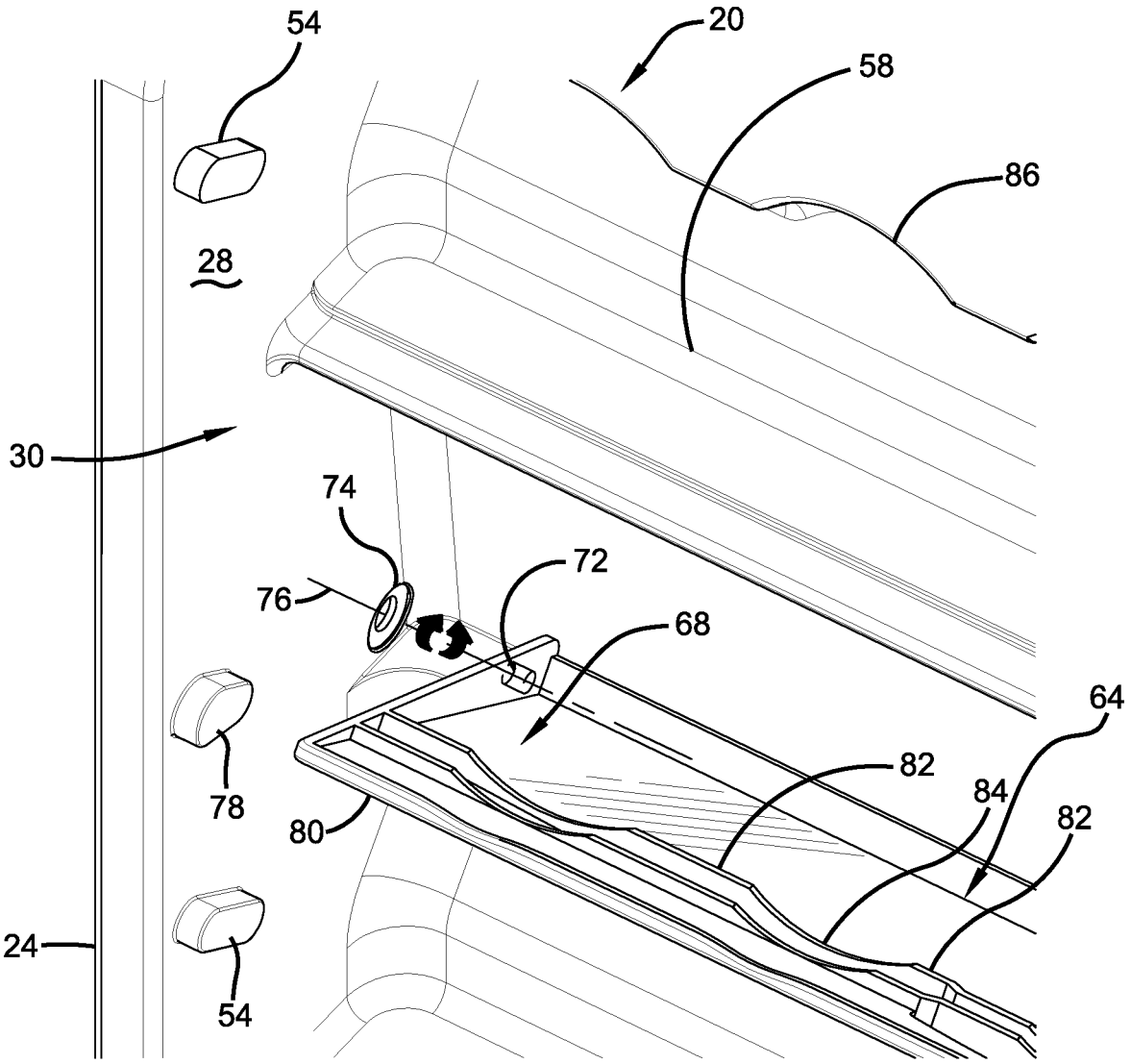
FIG. 5 is a perspective exploded partial view of a foldout door shelf in movable, operatively supported connection with the door.

In the exemplary embodiment each of the foldout door shelves 64 and 66 are the same. Therefore only foldout door shelf 64 shall be described in detail. As shown in FIG. 5, foldout door shelf 64 is movably mounted in operatively rotatable supported connection with each of door projections 22 and 24. Each horizontal side of foldout door shelf 64 has extending horizontally therefrom a shaft projection 72. Each shaft projection is engaged in a recess 74 that extends in the respective adjacent side face of the door projection. This configuration enables the foldout door shelf 64 to be rotatable about a horizontal axis 76.

In the exemplary embodiment each foldout door shelf is enabled to move in the recess 30 bounded by the door projections 22 and 24. The foldout door shelf is movable to extend outwardly relative to the vertical extending inside face 58 of the door through counterclockwise rotation about an axis 76 as shown in FIG. 5, until the shelf is engaged with a pair of shelf stop projections, such as shelf stop projection 78. The exemplary shelf stop projections extend inwardly in the recess 30 from the respective side faces 26, 28 of the door projections 22, 24. When the exemplary foldout door shelf 64 is engaged with the shelf stop projections 78, the item support surface 68 extends substantially at the same acute angle as the shelf front walls 42 of the door shelves 32, 34 when the door shelves are attached to the door and positioned in the second configuration. For purposes of this paragraph substantially the same angle shall be considered the same angle relative to vertical ±20°.

In the exemplary arrangement, the foldout door shelves are rotatable about the respective axis 76 clockwise as shown in FIG. 5 to a first foldout door shelf position in which the respective item support surface of the respective foldout door shelf is in adjacent facing substantially parallel relation with substantially vertically extending inside face 58. In this position each foldout door shelf is retracted in the recess 30 and is positioned adjacent to the inside face of the door. In this position the outermost portion 80 of the foldout door shelf that is disposed away from the axis is positioned intermediate of the substantially vertically extending inside face 58 and an inner face of the shelf bottom wall 40 of the door shelf that is attached to the door. This feature prevents the foldout door shelf from moving out of the retracted first foldout door shelf position adjacent to the door, so that the foldout door shelf does not interfere with tall items that may be positioned in the shelf storage recess 43 of the door shelf or other shelf below. Of course it should be understood that this configuration is exemplary and in other embodiments other configurations and arrangements may be used.

In the exemplary embodiment the item support surfaces 68, 70 of the foldout door shelves include horizontally disposed item separating projections 82. The exemplary item separating projections extend upward relative to the item support surface when the respective foldout door shelf is in the extended second foldout door shelf position as shown in FIG. 5. Arcuate recesses 84 extend between each immediately adjacent pair of item separating projections. The arcuate recesses are configured to accept therein the circular side walls of cans or other similar containers which may be positioned in supported connection with the respective foldout door shelf. The item separating projections 82 and arcuate recesses 84 may be used to position and align cans or other containers in spaced relation in connection with the foldout shelf. Such arcuate recesses 84 may be helpful in preventing cans or other containers from moving during the opening and closing of the refrigerator door. Of course these approaches are exemplary and in other embodiments other approaches may be used.

In exemplary embodiments, the inside faces 20 of the door may also include a plurality of disposed arcuate recesses 86 as shown in FIGS. 2, 3 and 6. Such arcuate recesses may be configured to position and separate cans or other containers that are in supporting connection with door shelves 32, 34 when the door shelves are in the second configuration. As can be appreciated such arcuate recesses 86 may be utilized for purposes of positioning standard diameter cans or other containers in spaced relation in supporting connection with the door shelves. Such arcuate recesses 86, like arcuate recesses 84, may be useful in preventing unwanted movement of cans or other containers during movement of the refrigerator door between the open and closed positions. Of course these approaches are exemplary and other embodiments other approaches may be used.

In the exemplary refrigerator 10, the exemplary door shelves 32 and 34 may be positioned as shown in FIG. 2 to hold items in supported connection therewith in a substantially vertical orientation. For purposes of such items, substantially vertical has the same meaning as the same term used in connection with the shelf front wall. This is represented by the can 62 shown in supported connection with door shelf 32 in FIG. 2. In this configuration the foldout door shelves 64, 66 may be in the retracted first foldout door shelf position and are held in this position by engagement with a respective adjacent door shelf.

To change the configuration of the shelves so that additional average cans or other containers may be held in the recess 30 of the exemplary door, the door shelves 32, 34 are detached from engagement with the door. The foldout door shelves 64, 62 are then rotated outwardly to extended positions as shown in FIG. 6. The door shelves 32, 34 may then be reattached to the door in the second configuration. With the door shelves and the foldout shelves positioned in the respective positions shown in FIG. 6, each of the shelves may then be loaded with cans 88 as shown in FIG. 7. In this condition each of the cans are positioned in a tilted orientation and a central axis of each can extends at an acute angle relative to the vertical direction and in a direction away from the vertically extending door inside face 58. As can be appreciated from FIG. 7 the number of standard size cans that can be held in supported connection with the door is at least doubled in the exemplary arrangement through the use of the foldout door shelves.

In the exemplary arrangement when the storage provided by the foldout door shelves 64, 66 is no longer needed, one or both of the foldout door shelves may be returned to the retracted first foldout door shelf position adjacent to the inside door face. The respective overlying door shelf 32 or 34 may be detached from the door and then reattached in either configuration to hold the foldout shelf retracted. This enables the exemplary embodiment to have between one and four selectively oriented shelves in the door that will hold cans or other containers in the tilted condition. Of course as can be appreciated, one of the door shelves 32, 34 may be positioned in the first configuration with the shelf front wall thereof extending substantially vertically, while the other door shelf is positioned with the shelf front wall thereof extending in the tilted condition at an acute angle. The exemplary embodiment provides for numerous different configurations for storage depending on the needs of the user.

Of course it should be understood that the shelf configurations and the numbers of shelves shown in connection with refrigerator 10 is exemplary. Other embodiments may include different numbers and configurations of shelves. While the exemplary embodiment has been discussed in connection with the storage of standard sized cans which are commonly used for holding beverages, other embodiments may be configured to hold other types and configurations of containers. The discussion of the exemplary embodiments provide teachings which may be utilized by persons having skill in the relevant art to produce other configurations which employ the inventive teachings set forth herein.

Thus the exemplary embodiments achieve improved operation, eliminate difficulties encountered in the use of prior devices and systems, and attain the useful results described herein.

In the foregoing description certain terms have been used for brevity, clarity and understanding. However, no unnecessary limitations are to be implied therefrom because such terms are used for descriptive purposes and are intended to be broadly construed. Moreover, the descriptions and illustrations herein are by way of examples and the inventive features are not limited to the exact features shown and described.

Further in the following claims any feature described as a means for performing a function shall be construed as encompassing any means known to those skilled in the art as being capable of carrying out the recited function, and shall not be deemed limited to the particular means shown or described for performing the recited function in the foregoing description or mere equivalents thereof.

Having described the features, discoveries and principles of the exemplary embodiments, the manner in which they are constructed and operated, and the advantages and useful results attained; the new and useful structures, devices, elements, arrangements, parts, combinations, systems, equipment, operations, methods, processes and relationships are set forth in the appended claims.

I claim:

1. Apparatus comprising:

a refrigerator including a housing, wherein the housing bounds a refrigerator interior area, a door, wherein the door is in movable operative supported connection with the housing, wherein the door is movable between an open position wherein the interior area is accessible from outside the housing, and a closed position wherein the interior area is not accessible from outside the housing, wherein the door includes a vertically extending inside face, wherein the inside face is in facing relation with the interior area when the door is in the closed position, a pair of horizontally disposed door projections, wherein the door projections extend away from the door inside face and toward the interior area when the door is in the closed position, wherein each door projection includes a side face, wherein a side face of one door projection of the pair is in substantially facing relation with the side face of the other door projection of the pair, wherein the door projections bound a door recess therebetween, at least one door shelf, wherein each door shelf is separable from the door and includes a pair of shelf side walls, wherein each respective shelf side wall of the pair extends vertically in the door recess adjacent to a respective side face, a shelf bottom wall, wherein the shelf bottom wall extends between the shelf side walls, a shelf front wall, wherein the shelf front wall extends between the shelf side walls and substantially perpendicular to the shelf bottom wall, wherein the shelf side walls, shelf bottom wall and shelf front wall bound a shelf storage recess of the respective door shelf, a plurality of releasably interengageable shelf projections and shelf recesses associated with each door shelf, wherein each respective door shelf includes one of either a shelf projection or a shelf recess in fixed operatively attached connection with each respective shelf side wall, and wherein each respective side face immediately adjacent to the respective shelf side wall includes the other of the shelf projection or the shelf recess, wherein the plurality of releasably interengageable shelf projections and shelf recesses associated with each respective door shelf are selectively interengageable in each of a first shelf configuration and a second shelf configuration, wherein in each of the first and second shelf configurations the respective door shelf extends in the door recess, is operatively supported by the door projections through the interengagement of the shelf projections and shelf recesses, and is fixed and movable relative to the door only linearly straight in a disengagement direction, wherein movement in the disengagement direction causes the respective door shelf to move upward relative to the door, wherein a respective door shelf that is in either the first shelf configuration or the second shelf configuration is changeable to the other of the first and second shelf configuration only through disengagement of the shelf projections and recesses by movement of the respective door shelf in the disengagement direction and reengagement of the shelf projections and recesses in the other of the first or second shelf configuration by movement in a linearly straight reengagement direction, wherein when a respective door shelf is in the first shelf configuration the shelf bottom wall of the respective door shelf extends substantially horizontally and the shelf front wall of the respective door shelf extends substantially vertically, and wherein when the respective door shelf is in the second shelf configuration the shelf bottom wall of the respective door shelf extends outward relative to the door inside face at an obtuse angle and the shelf front wall of the respective door shelf extends outward relative to the door inside face at an acute angle.

2. The apparatus according to claim 1 and further including at least one foldout door shelf, wherein each foldout door shelf is in movable rotatable supported connection with each of the pair of horizontally disposed door projections, wherein each respective foldout door shelf is only movable through rotational movement about a respective fixed horizontal axis, includes a foldout shelf item support surface, and is rotatably movable in the door recess about the respective horizontal axis between a first foldout door shelf position, wherein the foldout shelf item support surface is in facing parallel relation with the door inside face, and a second foldout door shelf position, wherein the foldout shelf item support surface extends outwardly relative to the door inside face at an acute angle.

3. The apparatus according to claim 2 wherein one respective door shelf that is in operative engagement with the door and in the first shelf configuration, includes the one respective door shelf storage recess, wherein in the first shelf configuration the one respective door shelf storage recess is accessible whereby items may be inserted and removed from the one respective door shelf storage recess through an upper opening to the storage recess, and wherein the one respective door shelf in the first shelf configuration is operative to prevent one respective foldout door shelf that is in the first foldout door shelf position, from being moved to the second foldout door shelf position.

4. The apparatus according to claim 2 wherein one respective door shelf that is in operative engagement with the door and in the first shelf configuration is operative to prevent one respective foldout door shelf that is in the second foldout door shelf position from being moved to the first foldout door shelf position.

5. The apparatus according to claim 2 and further including at least one respective stop, wherein one respective stop is in operative connection with one respective foldout door shelf, wherein the one respective stop is operative to limit outward rotational movement of the one respective foldout door shelf away from the first foldout door shelf position to the second foldout door shelf position, wherein the one respective stop is operative to hold the foldout door shelf in the second foldout door shelf position.

6. The apparatus according to claim 5 wherein the one respective stop includes a pair of inward facing stop projections, wherein each stop projection extends in the door recess from a respective door projection.

7. The apparatus according to claim 2 wherein the at least one shelf projection comprises a pair of opposed shelf projections, wherein each shelf projection extends from a respective side face of a respective door projection.

8. The apparatus according to claim 2 wherein in the second foldout door shelf position, the foldout shelf item support surface of each foldout door shelf extends in substantially parallel relation of the front wall of the each door shelf in the second shelf configuration.

9. The apparatus according to claim 2 wherein the foldout shelf item support surface of each respective foldout door shelf includes a plurality of horizontally disposed item separating projections extending therefrom, wherein when the respective foldout door shelf is in the second foldout door shelf position, the item separating projections extend upwardly relative to the respective foldout shelf item support surface.

10. The apparatus according to claim 9 wherein an arcuate recess extends between each immediately adjacent pair of item separating projections.

11. The apparatus according to claim 2 wherein the at least one door shelf includes a pair of vertically disposed door shelves in operatively supported connection with the door, wherein each of the pair of vertically disposed door shelves is in the first shelf configuration, wherein one foldout shelf item support surface of a respective one foldout door shelf is positionable in the second foldout door shelf position vertically intermediate of the pair of vertically disposed door shelves.

12. The apparatus according to claim 2 wherein the at least one door shelf includes a pair of vertically disposed door shelves in operatively supported connection with the door, wherein each of the pair of vertically disposed door shelves is in the first shelf configuration, wherein a first foldout shelf item support surface of a respective one foldout door shelf is positionable in the second foldout door shelf position vertically intermediate of the pair of vertically disposed door shelves, and wherein a second foldout door shelf item support surface of a respective one other foldout door shelf is positionable in the second foldout door shelf position vertically below a lower one of the door shelves.

13. The apparatus according to claim 12 wherein with each of the pair of door shelves respectively in the second shelf configuration, and each of the one foldout door shelf and the another foldout door shelf each respectively in the second foldout door shelf position, each of the pair of door shelves, the one foldout door shelf and the another foldout door shelf is configured to support a plurality of cylindrical beverage containing cans thereon, wherein each beverage containing can has a central axis, wherein the central axis extends at an acute angle relative to vertical and in a direction away from the door inside face.

14. The apparatus according to claim 12 wherein with each of the door shelves respectively in the first shelf configuration and each of the one foldout door shelf and the another foldout door shelf respectively in the first foldout door shelf position, each of the respective one foldout door shelf and the another foldout door shelf is not movable from the respective first foldout door shelf position to the respective second foldout door shelf position due to a respective adjacent door shelf that prevents such movement.

15. Apparatus comprising:

a refrigerator including housing, wherein the housing bounds a refrigerator interior area, a door, wherein the door is in movable operative supported connection with the housing, wherein the door is movable between an open position wherein the interior area is accessible from outside the housing, and a closed position wherein the interior area is not accessible from outside the housing, wherein the door includes at least one inside face, wherein the at least one inside face is exposed to the refrigerator interior area when the door is in the closed position, at least one door shelf, wherein the at least one door shelf is releasably operatively engageable with and disengageable from the at least one door inside face, wherein each door shelf includes a shelf front wall and a shelf bottom wall that bound a storage recess, wherein the shelf front wall extends substantially perpendicular to the shelf bottom wall, wherein each respective door shelf is operatively engageable in attached relation with the at least one inside face in a first shelf configuration and a second shelf configuration, wherein in the first shelf configuration the shelf front wall of the respective door shelf extends substantially vertically and the respective door shelf is not rotationally movable relative to the at least one inside face and is movable relative to the inside face only through movement in a linearly straight disengagement direction, wherein the respective door shelf is changeable to the second shelf configuration only through movement of the respective shelf from the first shelf configuration in the disengagement direction which is operative to cause the respective shelf to be disengaged from the door, and wherein in the second shelf configuration the front shelf surface of the respective shelf extends at an acute angle relative to vertical, and the respective door shelf is not rotationally moveable relative to the at least one inside face and is movable relative to the inside face only through movement in a further linearly straight disengagement direction, wherein the respective door shelf is changeable to the first shelf configuration only through movement of the respective shelf from the second shelf configuration in the further disengagement direction which is operative to cause the respective shelf to be disengaged from the door, wherein in the first shelf configuration, movement in the disengagement direction is operative to cause the respective door shelf to be moved upward relative to the door and in the second shelf configuration, movement in the further disengagement direction is operative to cause the respective shelf to be moved upward relative to the door.

16. The apparatus according to claim 15 and further including at least one foldout door shelf, wherein each foldout door shelf is in operatively supported rotatable connection with the at least one inside face, includes a respective foldout shelf item supporting surface, is movable between a respective first foldout door shelf position in which the respective foldout shelf item supporting surface extends substantially vertically, and a respective second foldout door shelf position in which the respective foldout shelf item supporting surface extends at the acute angle relative to vertical, and wherein one respective door shelf in the first shelf configuration is operative to prevent one respective foldout door shelf that is vertically below the one respective door shelf and respectively in the first foldout door shelf position, from being moved to the second foldout door shelf position.

17. The apparatus according to claim 16 wherein the at least one door shelf includes a pair of vertically spaced door shelves, and wherein the at least one foldout door shelf includes a pair of foldout door shelves wherein one respective foldout door shelf of the pair in the respective second foldout door shelf position, extends vertically intermediate of the door shelves, and another respective foldout door shelf of the pair in the respective second foldout door shelf position, extends below the vertically lowest door shelf, and when each of the door shelves are in the first shelf configuration, each respective one of the pair of foldout door shelves is held in the first foldout door shelf position by engagement with a respective door shelf.

18. Apparatus comprising:

a refrigerator including housing, wherein the housing bounds a refrigerator interior area, a door, wherein the door is in movable operative supported in connection with the housing, wherein the door is movable between an open position wherein the interior area is accessible from outside the housing, and a closed position wherein the interior area is not accessible from outside the housing, wherein the door includes a vertically extending inside face, wherein the inside face is in facing relation with the interior area when the door is in the closed position, a pair of horizontally disposed door projections, wherein the door projections extend away from the door inside face and toward the interior area when the door is in the closed position, wherein the door projections horizontally bound a door recess, wherein each door projection includes a side face, wherein a side face of one door projection of the pair is in substantially facing relation with the side face of the other door projection of the pair, wherein each side face includes at least one of an engagement projection or an engagement recess, at least one door shelf, wherein each door shelf is separable from the door and includes a pair of shelf side walls, wherein each respective shelf side wall of the pair extends vertically in the door recess adjacent to a respective side face, wherein each side face includes the other of the at least one engagement projection or the engagement recess, a shelf bottom wall, wherein the shelf bottom wall extends between the shelf side walls, a shelf front wall, wherein the shelf front wall extends between the shelf side walls and substantially perpendicular to the shelf bottom wall, wherein the shelf side walls, shelf bottom wall, and shelf front wall bound a shelf storage recess of the respective door shelf, wherein the at least one engagement projection and the at least one engagement recess are releasably interengageable, and are operative to be interengaged and hold the shelf in rotationally fixed relation relative to the door in either a first shelf configuration or a second shelf configuration, wherein in the first shelf configuration the bottom shelf wall extends substantially horizontally and the shelf front wall extends substantially vertically, and wherein in the second shelf configuration the bottom wall extends outward relative to the door inside face at an obtuse angle and the shelf front wall extends outward relative to the door inside face at an acute angle, at least one foldout door shelf, wherein each foldout door shelf is in movable rotatable supported connection with each of the pair of door projections, includes a foldout shelf item support surface, and is rotatably movable in the door recess between a first foldout door shelf position, wherein the foldout item support surface is in facing parallel relation with the door inside face, and a second foldout door shelf position, wherein the foldout shelf item support surface extends outwardly relative to the door inside face at an acute angle, wherein a first door shelf in the first shelf configuration is operative to prevent a first foldout door shelf in the first foldout door shelf position, from moving to the second foldout door shelf position, and wherein the first foldout door shelf is enabled to move between the first foldout door shelf position and the second foldout door shelf position when the first door shelf is in the second configuration.

19. The apparatus according to claim 18 wherein the first door shelf when in operative engagement with the door in the first shelf configuration is operative to prevent the first foldout door shelf in the second foldout door shelf position from being moved to the first foldout door shelf position.

20. Apparatus comprising a refrigerator including housing, wherein the housing bounds a refrigerator interior area, a door, wherein the door is in movable operative supported connection with the housing, wherein the door is movable between an open position wherein the interior area is accessible from outside the housing, and a closed position wherein the interior area is not accessible from outside housing, wherein the door includes a vertically extending inside face, wherein the inside face is in facing relation with the interior area when the door is in the closed position, a pair of horizontally disposed door projections, wherein the door projections extend away from the door inside face and toward the interior area when the door is in the closed position, wherein each door projection includes a side face, wherein a respective side face of one door projection of the pair is in substantially facing relation with the respective side face of the other door projection of the pair, wherein the door side faces horizontally bound a door recess, at least one door shelf, wherein each door shelf includes a pair of shelf side walls, wherein each respective shelf side wall of the pair extends vertically in the door recess adjacent to a respective side face, a shelf bottom wall, wherein the shelf bottom wall extends between the shelf side walls, a shelf front wall, wherein the shelf front wall extends between the shelf side walls and substantially perpendicular to the shelf bottom wall, wherein the shelf side walls, the shelf bottom wall, and the shelf front wall bound a shelf storage recess of the respective door shelf, wherein each door shelf is selectively positionable in engagement with the door in a first shelf configuration and in a second shelf configuration, wherein in the first shelf configuration the shelf bottom wall extends substantially horizontally and the shelf front wall extends substantially vertically, and wherein in the second shelf configuration the shelf bottom wall extends outward relative to the door inside face at an obtuse angle and the shelf front wall extends outward relative to the door inside face at an acute angle, wherein in each of the first and second shelf configurations of each door shelf, the shelf front wall and the shelf bottom wall are each in rotationally fixed relation relative to the door projections, at least one foldout door shelf, wherein each foldout door shelf is in operatively supported rotatable connection with the at least one inside face, includes a foldout shelf item supporting surface, is movable between a first foldout door shelf position in which the foldout shelf item supporting surface extends substantially vertically, and a second foldout door shelf position in which the foldout shelf item supporting surface extends at the acute angle, wherein a first door shelf in the first shelf configuration is operative to prevent a first foldout door shelf that is in the first foldout door shelf position from being movable to the second foldout door shelf position.

21. Apparatus comprising:

a refrigerator including housing, wherein the housing bounds a refrigerator interior area, a door, wherein the door is in movable operative supported connection with the housing, wherein the door is movable between an open position wherein the interior area is accessible from outside the housing, and a closed position wherein the interior area is not accessible from outside the housing, wherein the door includes a vertically extending inside face, wherein the inside face is in facing relation with the interior area when the door is in the closed position, at least one door shelf, wherein each door shelf is in operatively supported connection with the door and includes a shelf bottom wall, a shelf front wall, wherein the shelf front wall extends substantially perpendicular to the shelf bottom wall, wherein each at least one door shelf is selectively positionable relative to the door in a first shelf configuration and in a second shelf configuration, wherein in the first shelf configuration the shelf bottom wall extends substantially horizontally and the shelf front wall extends substantially vertically, wherein in the second shelf configuration the shelf bottom wall extends outward relative to the door inside face at an obtuse angle and the shelf front wall extends outward relative to the door inside face at an acute angle, and wherein in each of the first shelf configuration and the second shelf configuration each of the shelf front wall and the shelf bottom wall are held in rotationally fixed relation relative to the door, at least one foldout door shelf, wherein each at least one foldout door shelf is in movable rotatable supported connection with the door, includes a foldout shelf item support surface and is rotatably movable in operatively supported connection with the door between a first foldout door shelf position, wherein the foldout shelf item support surface is in facing parallel relation with the door inside face, and a second foldout door shelf position, wherein the foldout shelf item support surface extends outwardly relative to the door inside face at an acute angle, wherein a first door shelf in the first shelf configuration is operative to prevent a first foldout door shelf that is in the first foldout door shelf position, from being movable to the second foldout door shelf position.

22. The apparatus according to claim 21 wherein the first door shelf in the second shelf configuration enables the first foldout door shelf to be movable between the first foldout door shelf position and the second foldout door shelf position.

23. The apparatus according to claim 22 wherein the door inside face includes a pair of horizontally disposed door projections, wherein the door projections extend away from the door inside face and toward the interior area when the door is in the closed position, wherein each door projection includes a respective side face, wherein a respective side face of one door projection of the pair is in substantially facing relation with the respective side face of the other door projection of the pair, wherein the side faces bound a door recess, wherein each of the at least one door shelf in each of the first shelf configuration and the second shelf configuration extend in the door recess, and wherein each of the at least one foldout door shelf in the second foldout door shelf position extends in the recess.

24. The apparatus according to claim 23 wherein each of the at least one shelf includes a pair of disposed shelf side walls, wherein the pair of shelf side walls bound the shelf storage recess, wherein each of the shelf side walls of a respective door shelf, when the respective shelf is in each of the first shelf configuration and the second shelf configuration, is in adjacent facing relation with, and in releasable engagement with, a respective one of the side faces via a plurality of interengaging engagement projections and engagement recesses.

25. The apparatus according to claim 24 wherein each of the at least one foldout door shelf is rotationally movably mounted in operative connection with each of the pair of door projections.

26. Apparatus comprising:

a refrigerator including a housing, wherein the housing bounds a refrigerator interior area, a door, wherein the door is in movable operative connection with the housing, wherein the door is movable between an open position, wherein the interior area is accessible from outside the housing, and a closed position, wherein the interior area is not accessible from outside housing, wherein the door includes a vertically extending inside face, wherein the inside face is in facing relation with the interior area when the door is in the closed position, a pair of horizontally disposed door projections, wherein the door projections extend away from the door inside face and toward the interior area when the door is in the closed position, wherein each door projection includes a side face, wherein a side face of one door projection of the pair is in substantially facing relation with the side face of the other door projection of the pair, wherein the door projections bound a door recess therebetween, at least one door shelf, wherein each door shelf is separable from the door and includes a pair of shelf side walls, wherein each respective shelf side wall of the pair extends vertically in the door recess adjacent to a respective side face, a shelf bottom wall, wherein the shelf bottom wall extends between the shelf side walls, a shelf front wall, wherein the shelf front wall extends between the shelf side walls and substantially perpendicular to the shelf bottom wall, wherein the shelf side walls, shelf bottom wall, and shelf front wall bound a shelf storage recess of the respective door shelf, a plurality of releasably interengageable shelf projections and shelf recesses associated with each door shelf, wherein the shelf projections associated with one respective door shelf comprise a pair of horizontally opposed shelf projections, wherein each shelf projection extends in the door recess from a respective side face of a respective door projection, wherein the shelf recesses associated with the respective door shelf include a respective first recess and a respective second recess on each shelf side wall of the respective door shelf, wherein each respective shelf projection is selectively interengageable in each of the respective first recess and second recess of the immediately adjacent shelf side wall, wherein the plurality of releasably interengageable shelf projections and shelf recesses associated with each respective door shelf are selectively interengageable in each of a first shelf configuration, wherein in the first shelf configuration of the respective door shelf, each shelf projection is interengaged with only a respective first recess, and a second shelf configuration, wherein in the second shelf configuration of the respective door shelf, each shelf projection is interengaged with only a respective second recess, wherein in each of the first and second shelf configurations, the respective door shelf extends in the door recess, is operatively supported by the door projections through the interengagement of the shelf projections and shelf recesses, and is movable relative the door only in a linearly straight disengagement direction, wherein movement in the disengagement direction is operative to cause the respective door shelf to move upward relative to the refrigerator door, wherein movement in the disengagement direction of a respective door shelf that is in either the first shelf configuration or the second shelf configuration is operative to cause disengagement of the respective door shelf and the door, wherein when a respective door shelf is in the first shelf configuration the shelf bottom wall of the respective door shelf extends substantially horizontally and the shelf front wall of the respective door shelf extends substantially vertically, and wherein when the respective door shelf is in the second shelf configuration, the shelf bottom wall of the respective door shelf extends outward relative to the door inside face at an obtuse angle and the shelf front wall of the respective door shelf extends outward relative to the door inside face at an acute angle, and further including at least one foldout door shelf, wherein each foldout door shelf is in movable rotatable supported connection with each of the pair of horizontally disposed door projections, wherein each respective foldout door shelf is only movable relative to the door through rotational movement about a respective fixed horizontal axis, includes a foldout shelf item support surface, and is rotatably movable in the door recess about the respective horizontal axis between a first foldout door shelf position, wherein the foldout shelf item support surface is in facing parallel relation with the door inside face, and a second foldout door shelf position, wherein the foldout shelf item support surface extends outwardly relative to the door inside face at an acute angle.

27. The apparatus according to claim 26 wherein each of the respective first recess and second recess on each respective shelf side wall extends from a single common recess opening.

28. The apparatus according to claim 27 wherein each respective first recess and respective second recess on each shelf side wall of the respective door shelf is bounded by a respective continuous border wall that extends in the door recess outward from each respective shelf side wall towards the respective immediately adjacent side face.

* * * * *